US009562716B2

(12) United States Patent
Guillard

(10) Patent No.: US 9,562,716 B2
(45) Date of Patent: Feb. 7, 2017

(54) METHOD AND APPARATUS FOR SEPARATING AIR BY CRYOGENIC DISTILLATION

(71) Applicant: L'Air Liquide, Societe Anonyme Pour l'Etude et l'Exploitation des Procedes Georges Claude, Paris (FR)

(72) Inventor: Alain Guillard, Houston, TX (US)

(73) Assignee: L'Air Liquide Société Anonyme Pour l'Étude Et l'Exploitation des Procedes Georges Claude, Paris (FR)

( * ) Notice: Subject to any disclaimer, the term of this patent is extended or adjusted under 35 U.S.C. 154(b) by 332 days.

(21) Appl. No.: 14/366,701

(22) PCT Filed: Dec. 13, 2012

(86) PCT No.: PCT/FR2012/052921
§ 371 (c)(1),
(2) Date: Jun. 19, 2014

(87) PCT Pub. No.: WO2013/093305
PCT Pub. Date: Jun. 27, 2013

(65) Prior Publication Data

US 2015/0000335 A1 Jan. 1, 2015

(30) Foreign Application Priority Data

Dec. 21, 2011 (FR) ..... 11 62172

(51) Int. Cl.
*F25J 3/00* (2006.01)
*F25J 1/00* (2006.01)
*F25J 3/04* (2006.01)

(52) U.S. Cl.
CPC ..... *F25J 1/0012* (2013.01); *F25J 1/00* (2013.01); *F25J 3/04* (2013.01); *F25J 3/04012* (2013.01);
(Continued)

(58) Field of Classification Search
CPC .. F25J 3/04951; F25J 3/00489; F25J 3/04866; F25J 3/04151; F25J 3/04163; F25J 3/04169; F25J 3/0412; F25J 3/0418; F25J 3/04; F25J 2230/02; F25J 2230/24; F25J 2230/30; F25J 2230/40; F25J 3/04957; F25J 3/04963; F25J 3/04133
(Continued)

(56) References Cited

U.S. PATENT DOCUMENTS 5,475,980 A 12/1995 Grenier et al.
6,295,838 B1 * 10/2001 Shah ..... F25J 3/04018 62/643
(Continued)

FOREIGN PATENT DOCUMENTS

DE 102005023434 12/2005
EP 0504029 9/1992
(Continued)

OTHER PUBLICATIONS

"Mixed Purity Oxygen Facility," Research Disclosure, Mason Publications, Hampshire, GB, No. 451, Nov. 1, 2001 (3 pp).
(Continued)

*Primary Examiner* — Keith Raymond
(74) *Attorney, Agent, or Firm* — Justin K. Murray

(57) ABSTRACT

An apparatus for separating air by cryogenic distillation comprises N air compressors (C1, C2, C3) connected so as to receive air at ambient pressure and designed to produce air at a first pressure above 12 bar absolute, N being at least 3, each of the compressors being driven by a single asynchronous motor (M1, M2, M3), the total power of the compressors being at least 10 MW.

12 Claims, 2 Drawing Sheets

(52) U.S. Cl.
CPC ..... *F25J 3/04018* (2013.01); *F25J 3/0489* (2013.01); *F25J 3/04109* (2013.01); *F25J 3/04133* (2013.01); *F25J 3/04151* (2013.01); *F25J 3/04163* (2013.01); *F25J 3/04169* (2013.01); *F25J 3/04775* (2013.01); *F25J 3/04781* (2013.01); *F25J 3/04866* (2013.01); *F25J 3/04951* (2013.01); *F25J 3/04957* (2013.01); *F25J 2230/02* (2013.01); *F25J 2230/24* (2013.01); *F25J 2230/30* (2013.01); *F25J 2230/40* (2013.01)

(58) Field of Classification Search
USPC ..... 62/640, 643, 644, 656
See application file for complete search history.

(56) References Cited

U.S. PATENT DOCUMENTS

| | | | | |
|---|---|---|---|---|
| 6,945,076 | B1 * | 9/2005 | Garnier | F25J 3/04296 62/643 |
| 2003/0033832 | A1 * | 2/2003 | Massimo | F25J 3/04018 62/643 |
| 2012/0174624 | A1 * | 7/2012 | Guillard | F25J 3/04515 62/640 |

FOREIGN PATENT DOCUMENTS

| | | |
|---|---|---|
| EP | 0992275 | 4/2000 |
| FR | 2949845 | 3/2011 |
| FR | 2956731 | 8/2011 |

OTHER PUBLICATIONS

"Oxygen Plants: 10 years of development and operation" in CEP Jul. 1979 (8 pp).

Turbomachinery Limitations for Large Air Separation Plants by Wolentarski, Cryogenic Processes and Equipment Conference, Century 2-Emerging Technology Conferences, San Francisco, California, Aug. 19-21, 1980 (3 pp).

PCT/FR2012/052921, International Search Report, Mar. 5, 2013 (3 pp).

* cited by examiner

METHOD AND APPARATUS FOR SEPARATING AIR BY CRYOGENIC DISTILLATION

CROSS REFERENCE TO RELATED APPLICATIONS

This application is a §371 of International PCT Application PCT/FR2012/052921, filed Dec. 13, 2012, which claims the benefit of FR1162172, filed Dec. 21, 2011, both of which are herein incorporated by reference in their entireties.

TECHNICAL FIELD OF THE INVENTION

The present invention relates to a method and apparatus for separating air by cryogenic distillation.

BACKGROUND

In order to limit engineering costs and to achieve purchasing savings through repetitiveness, standardised ranges of air separation apparatus have been created, ranging up to tonnages of around 700 Mt/day, or even 1000 Mt/day. These standardised productions do not always exactly correspond to the requirements of the customer or customers in terms of output and/or pressure but the cost on these small units is the main optimisation factor, and standardisation responds well to this key criterion.

Beyond these capacities, since the energy assumes greater and greater importance, so-called modular units have been introduced, the orientation this time being to standardise certain key parts, but to follow the requirements of the customers as closely as possible and to take into account in the sizing the parallel constraints of energy and investment.

EP-A-0504029 describes a pump cycle based on the concept of monomachine with a single large high-pressure air compressor.

This approach provides appreciable savings in investment compared with a traditional pump cycle, by introducing all the energy necessary with this single air machine, the discharge pressure of which may be between approximately 12 bara and 35 bara, whatever the purities and pressures of the productions required. However, this single machine, when we arrive at very high powers, is difficult to implement and starts with complex and expensive starting artifices at the motors, referred to as regulators. The number of manufacturers is also extremely small, which limits, without however destroying it, the technical and economic advantage of this approach. Some of these problems are described in "Turbomachinery Limitations for Large Air Separation Plants" by Wolentarski, Cryogenic Processes and Equipment Conference, Century 2—Emerging Technology Conferences, San Francisco, Calif., Aug. 19-21, 1980.

For reasons of maintenance and reliability, spare parts are purchased for all these critical machines, with regard to both the compressors and the motors. It is entirely acceptable to have a single set of spare parts for a group of identical machines installed on the same site, or even in the same country.

Depending on the power, the technology of the motors varies: in fact beyond 25 MW, there is on the market no motor other than synchronous, the current technology of asynchronous motors not making it possible to go beyond this limit without taking very great industrial risk.

The article "Oxygen Plants: 10 years of development and operation" in CEP July 1979 describes the use of synchronous motors and explains that three sizes of synchronous motor are stored for replacing the European compressors of the Air Liquide group, in the event of breakdown.

In general terms, the equipment cost of an air separation unit with cycles with a single high-pressure air compressor (apart from storage and vaporisation vessels and high-voltage utilities) breaks down into four main parts:

i) Compression function (compression, motor, starting equipment and associated electrics): 45% to 50%.

ii) Cold box function and associated equipment: 30% to 35%.

iii) Purification function for the hot part of the air before entry into the cold box: 10% to 15%.

iv) Miscellaneous: 5% to 10%.

It is therefore clear that reducing costs and increasing the reliability of the compressors, motors and starting equipment is a priority.

With methods using a cold booster driven by a turbine, as described in U.S. Pat. No. 5,475,870, or the methods as described in EP-A-0504029, all the power is introduced by the high-pressure air compressor. A booster is a compressor that compresses a gas from a pressure higher than atmospheric pressure. It is also possible to compress all the air at high pressure and not to use a booster or to use only boosters coupled to an air and nitrogen turbine, as in EP-A-0504029, so that all the power is introduced by a single high-pressure air compressor. The arrangements at the heat-exchange line, the number and type of turbines coupled to a booster and the distillation columns makes the productions compatible with the purities, pressures and throughputs required by the customer.

SUMMARY OF THE INVENTION

The present invention results from the fact that, for a customer requiring the supply of a product or products at a given throughput, a given purity and a given pressure, this supply necessarily corresponds to a power that results in a given throughput of air and a given high air pressure.

In order to preserve the advantage of being as close as possible to the requirements of customers, but standardising the key part to afford gains in repetitiveness on this part and gains by volume effect with the suppliers, but also and especially in being placed just this side of technological, technical or even economic thresholds (where there are a sizable number of potential suppliers), the number N of high-pressure compressors is between 3 and 10, in order to supply air to the cold box of the separation apparatus meeting the requirements of the customer. For example, 3, 4, 5, 6, 7, 8, 9 or 10 compressors in parallel may be used.

For a single cold box, for example using 25 MW of compression minimum, having a single associated purification unit, traditionally a single large compressor is used of the synchronous type. The present invention makes provision for using at least three sufficiently small compressors to be able to be driven by asynchronous motors in order to supply the single cold box.

According to one subject matter of the invention, a method for separating air by cryogenic distillation is provided, in which:

i) N flows of air are sent at approximately ambient pressure each to one of the N air compressors, ii) each of the N compressors compresses the air at a first pressure above 12 bar absolute and below 30 bar absolute, N being equal to or greater than 3 and the total power of the N compressors being greater than 10 MW, iii) the air is sent at the first pressure of the N compressors to a single purification unit in order to eliminate the water and carbon dioxide and the purified air is cooled in the purification unit before sending it to a single system of columns in a single cold box where the air is separated by cryogenic distillation, iv) an oxygen-enriched flow and/or a nitrogen-enriched flow is extracted from the system of columns, and v) air is sent from each of the N compressors to the system of columns through the purification unit, without sending air at the first pressure to an air booster driven by a motor or a steam turbine, and vi) the N compressors each being driven by a single motor, these N motors being asynchronous and having a maximum power below 25 MW.

According to other optional aspects:

- all the air sent to the system of columns comes from the N compressors,
- N is equal to 4, 5, 6, 7, 8, 9 or 10,
- the N air compressors each send no more than 100%/N of the air that they compress to the system of columns,
- all the air from the N air compressors is sent to the single purification unit and to the single box in order to be separated therein,
- each of the compressors sends at least 90% of its air to the system of columns, or even to the same column in the system of columns,
- each of the compressors produces air at the same pressure,
- each of the compressors compresses the same throughput,
- at least two of the compressors compress the same throughput,
- only two compressors compress the same throughput,
- each compressor compresses a different throughput,
- at least one compressor compresses a throughput different to that compressed by another compressor,
- at least some of the flow of air from each compressor is expanded before being sent to the system of columns,
- each of the motors is connected to a starter of a given type, the type of starter for each motor being either direct or by reactance or auto-transforming,
- the total power of the N compressors is less than 25×N MW, that is to say 150 MW for N compressors,
- the total power of the N compressors is greater than 25 MW, or even greater than 40 MW.

The compression of N flows of air to a first pressure covers the case where the first pressure is that of the mixed compressed flows, and at least one compressor compresses to a final pressure that differs by no more than 20% or even by no more than 10% from this first pressure. Thus the lack of pressure from a compressor can be compensated for by an output pressure greater than the first pressure from another of the N compressors.

According to another subject matter of the invention, there are provided an apparatus for air separation by cryogenic distillation comprising a single system of columns in a single cold box, N air compressors connected so as to receive air at ambient pressure and designed to produce air at a first pressure above 12 bar absolute, N being at least equal to 3, each of the compressors being driven by a single asynchronous motor, the total power of the compressors being at least 10 MW, a single purification unit for purifying air at the first pressure coming from the N compressors, pipes for sending purified air from the purification unit to the system of columns, a pipe for taking off a nitrogen-enriched flow from the system of columns and a pipe for taking off an oxygen-enriched flow from the system of columns, the apparatus not comprising any motor or steam turbine driving an air booster.

Each of the compressors may comprise at least 4 stages.

Each of the compressors may comprise the same number of stages.

Optionally one of the N compressors may supply some of its air otherwise than to the system of columns. Likewise the system of columns may also receive air from a compressor other than the N compressors.

In a variant, the system of columns receives only air from the N compressors and/or the N compressors send all their air to the system of columns.

A high-pressure compressor compresses air from atmospheric pressure up to between 12 and 35 bar absolute.

The N compressors may all be of the same model, this model preferably being defined by the manufacturer. Otherwise at least one of the compressors may be of one model and at least one other may be of another model, the total number of models used for compressing the compressed air not exceeding 2 or 3 or 4 or 5.

By combining these 3 to 10 compressors with each other, knowing that, for each model, there is potential flexibility of around 20% with regard to throughput and 30% with regard to output pressure, the total of all the powers necessary for any requirement in terms of product, throughput, pressure and purity corresponding to a power of between approximately 10 MW may be covered, by choosing the elements used downstream of the compressors, for example the turbines, boosters, exchangers, pumps and distillation columns and choosing the way of connecting them together, in a manner known to persons skilled in the art. For example, an apparatus may be used in which all the air is compressed at a single high pressure, some of the air at the high pressure is cooled in the exchange line and the rest is compressed in a booster and then expanded in a turbine driving the booster, before being sent to distillation. Other possible variants comprise the use of a supplementary air turbine that sends the air to atmosphere or a cold booster coupled to an air turbine intended for distillation.

With the majority of air separation appliances to be constructed in the world or in a given country, the same type of compressor could be used, in terms of output pressure and throughput of air to be compressed. According to the apparatus, a greater or lesser number of the same compressor could be used. This would make it possible to reduce the stocks of spare parts since the parts for a compressor of an apparatus will serve not only for the other compressors of the same apparatus but for the compressor of other items of apparatus.

By positioning just in front of the technological thresholds of these machines, just below 25 MW for example, only asynchronous motors can be installed, thus gaining in reliability, these machines being more robust than synchronous motors.

The power being relatively less great, direct start-ups, or even by reactance or autotransformer, of the motors of these machines can be effected instead of passing through regulators or soft starters that are very expensive for motors with very high capacities.

The compressors may be centrifugal or axial compressors.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

DETAILED DESCRIPTION

An apparatus according to an embodiment of the invention will be described in more detail with reference to the figures, which show schematic drawings.

Figure 1:
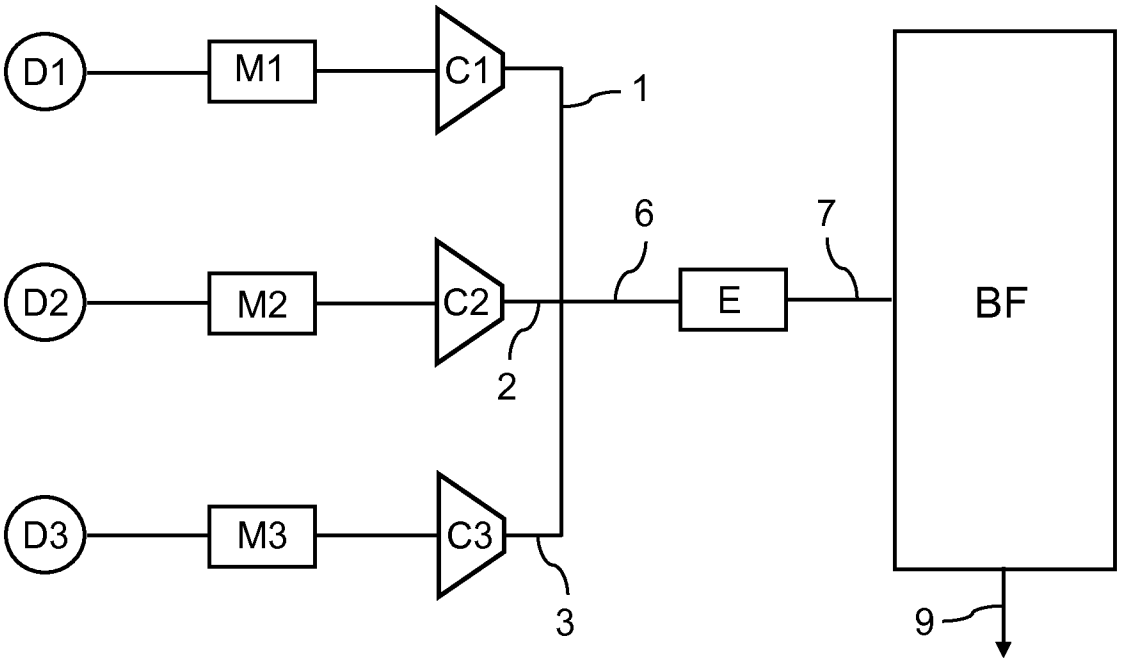
FIG. 1 provides an embodiment of the present invention.

In FIG. 1, a single cold box BF of an air separation apparatus contains a single system of columns and an exchanger for cooling the air to the distillation temperature. The air to be distilled 7 has previously been purified in a single purification unit E in order to remove the water and carbon dioxide.

The apparatus produces at least one product 9 that may be gaseous oxygen and/or gaseous nitrogen and/or liquid oxygen and/or liquid nitrogen and/or gaseous argon and/or liquid argon.

The air at atmospheric pressure is compressed in three compressors C1, C2, C3. Each of these compressors preferably has the same capacity. Each compressor compresses the air to the purification pressure, preferably equal to at least 12 bar absolute, preferably less than 35 bar absolute. The three flows of air 1, 2, 3 compressed in the compressors C1, C2, C3 are joined in a single flow 6 and purified together in the unit E.

All the air sent to the single cold box comes from the compressors C1, C2, C3 and the compressors C1, C2, C3 send all their air 6 to the cold box BF.

Each compressor C1, C2, C3 is driven by a single asynchronous motor M1, M2, M3. Each motor M1, M2, M3 has a respective starter D1, D2, D3, these starters being of the direct online, self or autotransformer type. None of the motors is started by a soft starter or a regulator, which enormously simplifies the installation.

Each of the compressors C1, C2, C3 comprises at least 4 stages.

The cold box, and therefore the three compressors, process air in order to produce at least 4000 tonnes per day of oxygen. Thus each compressor treats at least 6666 tonnes of air per day. The three compressors are driven by motors preferably at constant speed.

The total power of the three compressors is greater than 10 MW or greater than 25 MW, or even greater than 40 MW, but less than 75 MW.

The three compressors can each treat the same throughput, all a different throughput, or two the same throughput and the third a different throughput.

Here each compressor compresses the air from atmospheric pressure to the same first pressure; however, a certain variation in pressure may be tolerated. For example, one compressor may have a pressure that differs by no more than 20% (or even by no more than 10%) from the pressure of the flow 6 formed by mixing the compressed flows.

It will easily be understood that the invention can extend to appliances having four compressors, five compressors or six compressors in parallel. The precise case of five compressors is illustrated in FIG. 2.

Figure 2:
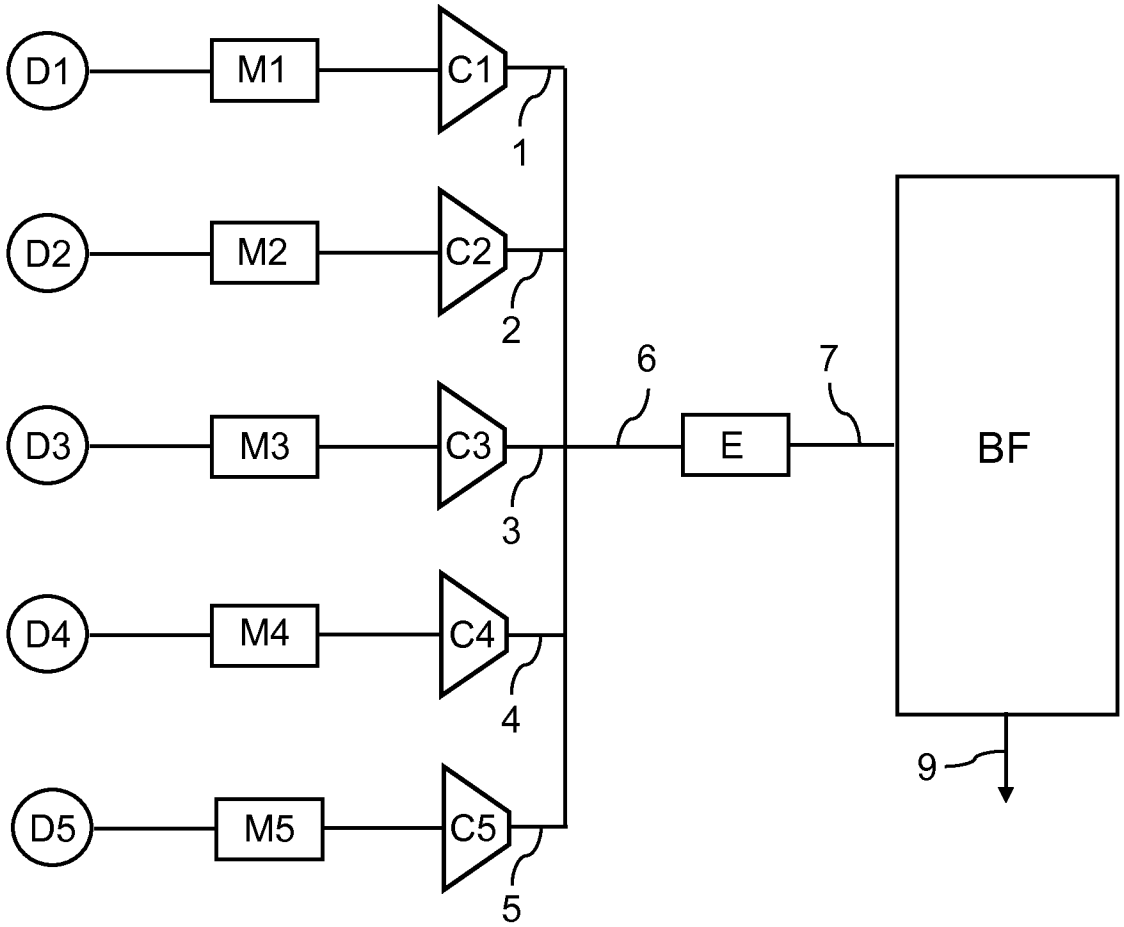
FIG. 2 provides an embodiment of the present invention.

In FIG. 2, a cold box BF of an air separation apparatus contains a system of columns and an exchanger for cooling the air to the distillation temperature. The air to be distilled 7 has previously been purified in a purification unit E in order to remove the water and carbon dioxide.

The apparatus produces at least one product 9 that may be gaseous oxygen and/or gaseous nitrogen and/or liquid oxygen and/or liquid nitrogen and/or gaseous argon and/or liquid argon.

The air at atmospheric pressure is compressed in five compressors C1, C2, C3, C4, C5, connected in parallel. Each of these compressors preferably has the same capacity. Each compressor compresses the air to the purification pressure, preferably equal to at least 12 bar absolute, preferably less than 35 bar absolute. The five flows of air 1, 2, 3, 4, 5 compressed in the compressors C1, C2, C3, C4, C5 are combined in a single flow 6 and purified together in the unit E.

All the air sent to the cold box comes from the compressors C1, C2, C3, C4, C5 and the compressors C1, C2, C3, C4, C5 send all their air to the cold box BF.

Each of the compressors C1, C2, C3, C4, C5 comprises at least 4 stages.

Each compressor C1, C2, C3, C4, C5 is driven by a single asynchronous motor M1, M2, M3, M4, M5. Each motor M1, M2, M3, M4, M5 has a respective starter D1, D2, D3, D4, D5, these starters being of the direct online, self or autotransformer type. None of the motors is started by a soft starter or regulator, which enormously simplifies the installation.

The five compressors may each treat the same throughput, each a different throughput or there may be pairs of compressors having the same throughput.

The total power of the five compressors is greater than 10 MW or greater than 25 MW, or even greater than 40 MW but less than 125 MW.

The single cold box, and therefore the five compressors, process air in order to produce at least 4000 tonnes per day of oxygen. Thus each compressor processes at least 4000 tonnes per day of air. The five compressors are driven by motors preferably at substantially constant speed.

Here each compressor compresses the air from atmospheric pressure to the same first pressure; however, a certain variation in pressure may be tolerated. For example, one compressor may have a pressure that differs by no more than 20% (or even by no more than 10%) from the pressure of the flow 6 formed by mixing the compressed flows.

The air separation appliances according to the invention may comprise an air booster driven by an air turbine, for example sending the expanded air to a column of the cold box, or by a nitrogen turbine. On the other hand, the appliances do not comprise an air booster driven by a steam turbine or a motor since that would imply an input of energy into the system other than by the sending of compressed air from the N compressors.

Compressors of products, for oxygen or nitrogen, may on the other hand be used, these being driven for example by motors.

In general terms, the invention applies to methods where the total power of the compressors is less than 150 MW.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary a range is expressed, it is to be understood that another embodiment is from the one.

Optional or optionally means that the subsequently described event or circumstances may or may not occur. The description includes instances where the event or circumstance occurs and instances where it does not occur.

Ranges may be expressed herein as from about one particular value, and/or to about another particular value. When such particular value and/or to the other particular value, along with all combinations within said range.

All references identified herein are each hereby incorporated by reference into this application in their entireties, as well as for the specific information for which each is cited.

The invention claimed is:

1. A method for separating air by cryogenic distillation, the method comprising the steps of:

i) sending N flows of air at approximately ambient pressure each to one of N air compressors;

ii) compressing the air using each of the N compressors to a first pressure above 12 bar absolute and below 35 bar absolute, N being equal to or greater than 3 and the total power of the N compressors being greater than 10 MW;

iii) sending the air at the first pressure from the N compressors to a single purification unit in order to remove water and carbon dioxide and cooling the air in the purification unit before sending the cooled air to a single system of columns in a single cold box where the cooled air is separated by cryogenic distillation;

iv) extracting an enriched flow from the system of columns, wherein the enriched flow is selected from the group consisting of an oxygen-enriched flow, a nitrogen-enriched flow, and combinations thereof;

v) sending the air from each of the N compressors to the system of columns through the purification unit, without sending the air at the first pressure to an air booster driven by a motor or a steam turbine; and vi) driving each of the N compressors by a single motor, these N motors being asynchronous and having a maximum power below 25 MW.

2. The method according to claim 1, in which all the air sent to the system of columns comes from the N compressors.

3. The method according to claim 1, in which N is equal to 4, 5, 6, 7, 8, 9 or 10.

4. The method according to claim 1, in which the N air compressors each send no more than 100%/N of the air that the N air compressors compress to the system of columns.

5. The method according to claim 1, in which each of the compressors sends at least 90% of the air that each compressor compresses to the system of columns, or to the same column in the system of columns.

6. The method according to claim 1, in which at least some of the air flow from each compressor is expanded before being sent to the system of columns.

7. The method according to claim 1, in which each of the motors is connected to a starter of a given type, the type of starter for each motor being either direct or by reactance or auto transforming.

8. The method according to claim 1, in which the total power of the N compressors is less than 25 MW.

9. The method according to claim 1, in which the total power of the N compressors is greater than 25 MW.

10. The method according to claim 1, in which the total power of the N compressors is greater than 40 MW.

11. An apparatus for air separation by cryogenic distillation, the apparatus comprising:

a single system of columns in a single cold box;

N air compressors configured to receive air at ambient pressure and designed to produce air at a first pressure above 12 bar absolute, N being at least equal to 3, wherein each of the compressors is configured to be driven by a single asynchronous motor, the total power of the compressors being at least 10 MW;

a single purification unit configured to purify air at the first pressure coming from the N compressors;

pipes configured to send purified air from the purification unit to the system of columns, a pipe for taking off a nitrogen-enriched flow from the system of columns; and a pipe configured to remove an oxygen-enriched flow from the system of columns, the apparatus comprising an absence of a motor or steam turbine driving an air booster.

12. An apparatus according to claim 11, in which each of the compressors comprises at least 4 stages.

* * * * *